US007632042B2

(12) United States Patent
Brafford, Jr. et al.

(10) Patent No.: US 7,632,042 B2
(45) Date of Patent: Dec. 15, 2009

(54) METHOD, APPARATUS AND SYSTEM FOR FORMING DRAINAGE AND TRENCH FORMING SYSTEMS

(75) Inventors: Ralph E. Brafford, Jr., Mooresville, NC (US); Roger J. Morrow, Statesville, NC (US); Timothy H. Wallace, Charlotte, NC (US); Bryan A. Hendrix, Mocksville, NC (US)

(73) Assignee: ABT, Inc., Troutman, NC (US)

( * ) Notice: Subject to any disclaimer, the term of this patent is extended or adjusted under 35 U.S.C. 154(b) by 434 days.

(21) Appl. No.: 11/754,512

(22) Filed: May 29, 2007

(65) Prior Publication Data

US 2008/0025797 A1 Jan. 31, 2008

Related U.S. Application Data

(60) Provisional application No. 60/803,312, filed on May 26, 2006.

(51) Int. Cl.
*E03F 3/04* (2006.01)
*E03F 5/06* (2006.01)

(52) U.S. Cl. ..... 405/123; 405/118; 249/10; 249/11; 404/2; 404/3

(58) Field of Classification Search ..... 405/118–121, 405/123; 249/10–13; 404/2–4
See application file for complete search history.

(56) References Cited

U.S. PATENT DOCUMENTS

| | | | |
|---|---|---|---|
| 5,281,051 | A | 1/1994 | Stegall |
| 5,348,421 | A | 9/1994 | Stegall |
| 6,220,784 | B1 | 4/2001 | Bricker |
| 6,595,720 | B2 | 7/2003 | Humphries et al. |
| 6,926,245 | B2 | 8/2005 | Wallace et al. |
| 2004/0081515 | A1 | 4/2004 | Wallace et al. |

*Primary Examiner*—Tara Mayo-Pinnock
(74) *Attorney, Agent, or Firm*—Henry B. Ward, III; Moore & VanAllen PLLC

(57) ABSTRACT

An alignment device is disclosed use in maintaining the alignment of longitudinal frame members of a trench-forming assembly. The alignment device comprises a cross member. Extending in the same direction from opposite ends of the cross member is at least one pair of first lateral extensions. The pair of lateral extensions is spaced apart so as to contact the respective longitudinal frame members of the trench-forming assembly, and thereby maintain the two frame members at a distance relative to each other. The alignment device may further include at least one interior extension extending from the cross member in the same direction as the pair of first lateral extensions. In this embodiment, the interior extension defines a slot between the interior extension and at least one of the first lateral extensions, where the slot is structured is to receive at least a portion of one of the longitudinal frame members.

22 Claims, 8 Drawing Sheets

METHOD, APPARATUS AND SYSTEM FOR FORMING DRAINAGE AND TRENCH FORMING SYSTEMS

CROSS-REFERENCE TO RELATED APPLICATIONS

This patent application claims priority to and hereby incorporates by reference the entire contents of U.S. Provisional Patent Application No. 60/803,312 entitled: Method, Apparatus And System For Forming Drainage And Trench Forming Systems filed on May 26, 2006.

BACKGROUND OF THE INVENTION

1. Field of the Invention

This invention relates generally to drainage and trench forming systems and, more particularly, to a method, apparatus and system for forming drainage and trench forming systems.

2. Description of Related Art

Drainage and other trenches of various sizes and shapes are desirable for a number of applications. For example, manufacturing facilities typically require drainage systems that include trenches formed in the building floors to collect, remove, and/or recycle excess water or other liquids. These trenches may also be used as utility chases to provide temporary or permanent routing of electrical lines, pipes, conduits or the like below the level of the building floor. In addition, numerous outdoor industrial and commercial sites, such as parking lots, also require drainage systems, including trenches, to collect and direct rainwater and other liquids to underground storm sewers to prevent flooding and to decrease run-off. Similarly, roadways and the like may also require drainage systems, including trenches.

In the past, these trenches have generally been formed by first placing and securing a form of predetermined shape in a ditch that has previously been formed in the ground. A moldable trench forming composition, such as cementitious material, is then poured around the form and is allowed to set. Once the cementitious material has set, the form is removed from the resulting trench.

One type of form assembly used to define a trench includes a wooden form and strut structure. The wooden form includes a wooden frame which is covered with wooden sheets or planks to define a generally rectangular elongated trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Cementitious material is typically poured up to the bottom face of the form and allowed to set in order to anchor the wooden form in the ditch. Then, additional cementitious material is poured between the earthen walls of the ditch and the wooden sides of the form. Once all of the cementitious material has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

Commercially significant methods for forming trenches, together with improved removable forms for forming trenches, are disclosed in U.S. Pat. No. 5,281,051, which is assigned to the assignee of the present invention and incorporated herein by reference. In advantageous embodiments thereof, inexpensive forms are employed to form trenches instead of using the wooden forms discussed above. The trench-forming assembly disclosed in U.S. Pat. No. 5,281,051 preferably includes opposing longitudinal frame members having a plurality of anchoring rods extending downwardly from the frame members. An elongated form body, preferably formed of relatively lightweight expanded polystyrene, includes aligned longitudinal slots in the opposed side walls for receiving the frame members. Horizontal portions of the frame members are secured within the longitudinal slots in the sidewalls of the form body during formation of the trench so that the frame members are held in alignment during the trench forming operation.

Preferably the assembled form and frame members are placed into a prepared ditch by suspending the assembly from its top, such as by one or more batter boards. Cementitious material is first poured around the bottom of the anchoring legs attached to the frame members and allowed to set in order to anchor the anchoring legs and, in turn, the frame members and the form within the ditch. Then more cementitious material is poured around the form body and allowed to set. Finally the form body is removed to expose the resulting trench and the properly aligned frame members. The removal of the form may be facilitated by a pair of slots extending upwardly into the form body from its bottom surface. By removing an upper portion of the form to access the slots as shown in U.S. Pat. No. 5,281,051, the form body can be more easily removed from the trench in several pieces.

Regardless of the fabrication technique, it is normally desirable to finish the trench with an elongated grate covering its open top in order to prevent people from unwittingly stepping in the open trench, to provide a smooth surface for vehicle travel, and/or to prevent relatively large objects from entering the trench and potentially blocking the flow of liquid therethrough. For a trench formed and described by U.S. Pat. No. 5,281,051, the grate is generally supported by a pair of spaced apart frame members which are set into and extend from the walls of the concrete trench. In order to stabilize the grate and to prevent the grate from rocking when weight, such as from a passing vehicle, is applied thereto, the frame members must be aligned in a common plane during the pouring and setting of the concrete about the form. If the frame members and, in turn, the grate are not properly aligned, the grate, the frame members and/or the cementitious trench itself may be damaged by the resulting movement of the grate. Accordingly, the alignment of the frame members in the moldable trench forming composition is important.

As shown by U.S. Pat. No. 5,348,421, which is assigned to the assignee of the present invention and incorporated herein by reference, the frame members may be connected by generally U-shaped members. While the U-shaped members generally maintain the frame members in position with respect to one another, the frame members are still able to move somewhat with respect to one another. Such relative movement is typically undesirable since it may adversely alter the relative alignment of the frame members such that the grate no longer sits evenly upon the rails. As such, one or more tie wires have been conventionally utilized to secure the frame members to the form. In this regard, the tie wires generally wrap about the opposed frame members so as to bring the frame members into close-fitting contact with the opposite sides of the form.

Once the cementitious material has set and the frame members are correspondingly affixed in position, the tie wires can be removed prior to removing the form to expose the resulting trench. And while tie wires are adequate for securing the frame members to the form, it is typically desirous to improve the method by which frame members are secured to the form and alignment of the frame members maintained during formation of the trench.

BRIEF SUMMARY OF THE INVENTION

The present invention provides methods, apparatus, and systems for forming concrete or other types of hardening material. In particular, the present invention provides an alignment device for use in maintaining the alignment of longitudinal frame members of a trench-forming assembly during formation of a trench, where the longitudinal frame members are positioned in a generally parallel orientation about a form such that the longitudinal frame members are spaced at a distance apart from each other. The alignment device comprises a cross member. Extending in the same direction from opposite ends of the cross member is at least one pair of first lateral extensions. The pair of lateral extensions is spaced apart so as to contact the respective longitudinal frame members of the trench-forming assembly, and thereby maintain the two frame members at a distance relative to each other.

For example, in one embodiment, the pair of lateral extensions is spaced apart such that they fit or are in contact with the outside surfaces of the respective frame members. In this embodiment, the lateral extensions provide support or stabilization to restrict movement of the frame members away from one another. In other embodiments, the pair of lateral extensions is spaced apart such that they fit or are in contact with the inside surfaces of the respective frame members. In this embodiment, the lateral extensions provide support or stabilization to restrict movement of the frame members toward one another. In this embodiment, instead of a pair of lateral extensions, the alignment device could have one lateral extension that is sized to contact the inside surfaces of both frame members.

In some embodiments, the alignment device may further include at least one interior extension extending from the cross member in the same direction as the pair of first lateral extensions and corresponding to at least one of the pair of first lateral extensions. In this embodiment, the at least one interior extension defines a slot between the interior extension and at least one of the first lateral extension, where the slot structured is to receive at least a portion of one of the longitudinal frame members when the cross member extends between the longitudinal frame members to thereby maintain the alignment of the longitudinal frame members when forming the trench. In other embodiments, the interior lateral extension creates slots with both of the first lateral extensions, so as to create two slots, where each slot is sized to fit one of the longitudinal frame members. In still another embodiment, there are two interior extensions, such that each corresponds to one of the pair of first lateral extensions to thereby create two slots, where each slot is sized to fit one of the longitudinal frame members.

The present invention also provides a method of forming a trench of predetermined shape. The method comprises providing a trench-forming assembly comprising a form and a pair of longitudinal frame members secured to the form, the pair of longitudinal frame members being positioned in a parallel orientation about the form such that the longitudinal frame members are spaced apart a predetermined distance. The providing step can include forming slots in the form of the trench-forming assembly, each of the slots structured to receive at least one of the interior extension(s) of an alignment device. At least one alignment device is provided having at least one slot for at least partially receiving each one of the longitudinal frame members. The trench-forming assembly is positioned with a prepared ditch. The at least one alignment device is engaged with the trench-forming assembly whereby the at least one alignment device extends across the distance between the longitudinal frame members and each longitudinal frame member is at least partially received within at least one corresponding slot of the alignment device. The engaging step can be repeated so that the alignment devices are positioned at longitudinally spaced locations along the length of the trench-forming assembly. A moldable trench forming composition is poured around at least portions of the trench-forming assembly to form the trench of predetermined shape and wherein the at least one alignment device maintains the alignment of the longitudinal frame members during said pouring step.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
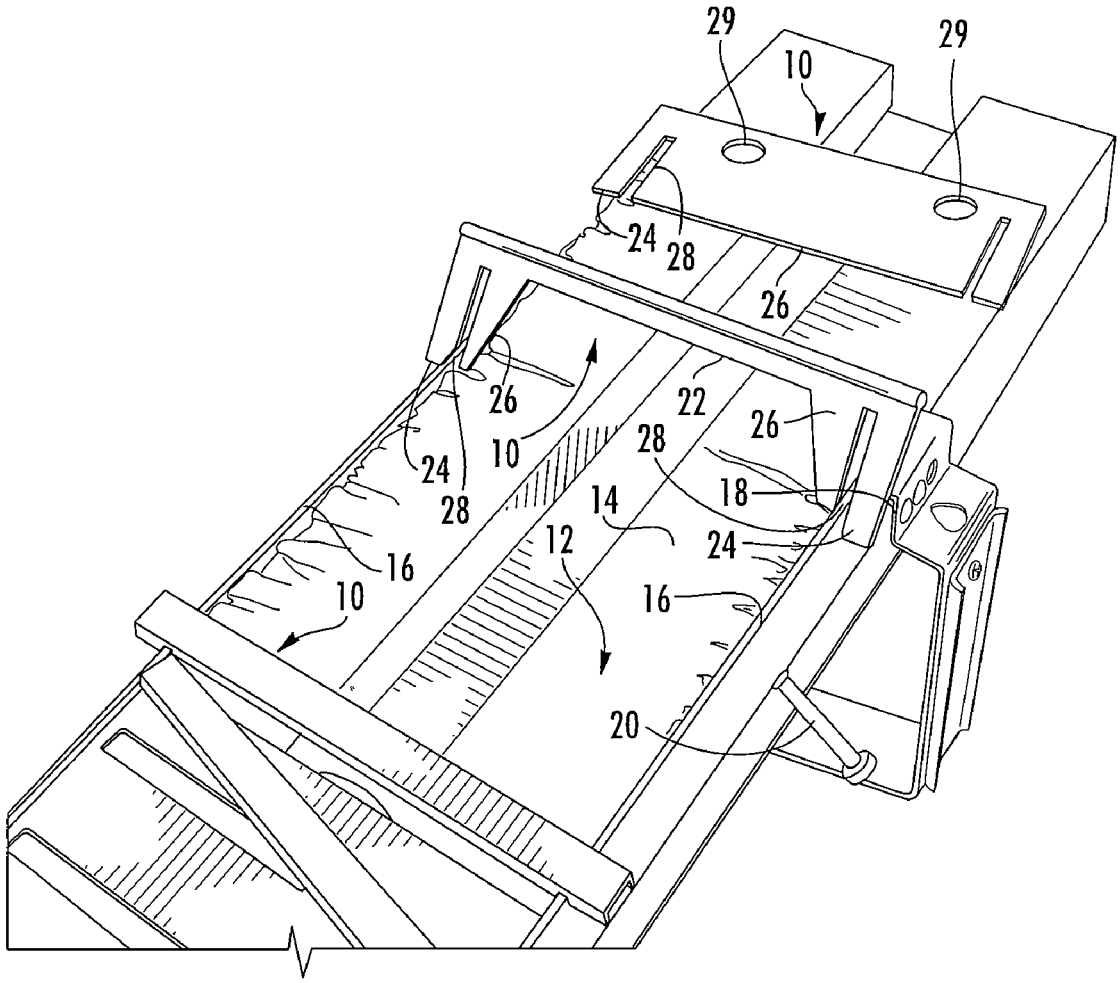
FIG. 1 illustrates an alignment device being engaged to a trench-forming assembly, according to one embodiment of the present invention.
Figure 2:
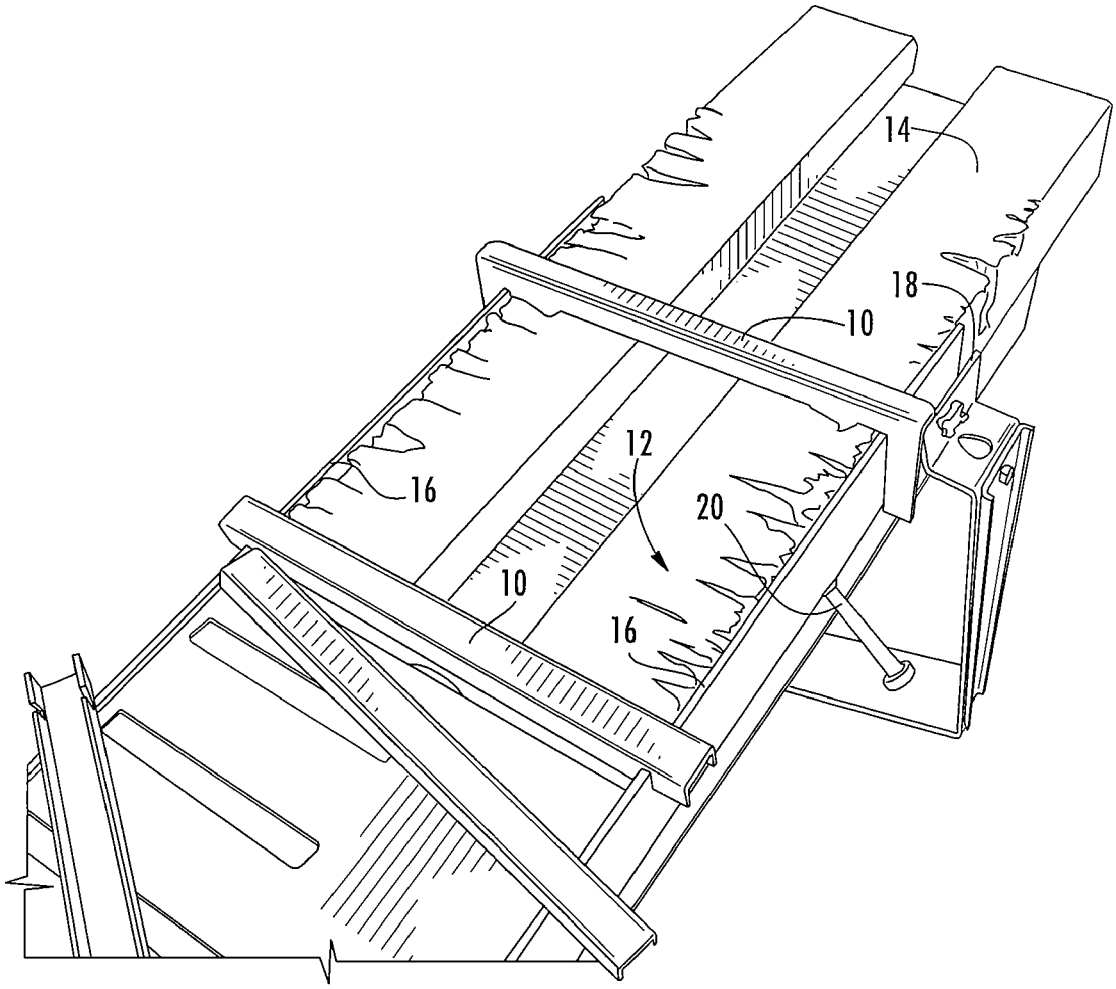
FIG. 2 illustrates the alignment device of FIG. 1 engaged to the trench-forming assembly.

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring to the drawings and, in particular, FIGS. 1-2 and 10-11 illustrate alignment devices 10 being engaged to a trench-forming assembly 12, according to various embodiments of the present invention, the trench forming assembly being structured to form a trench of a predetermined shape. The trench-forming assembly 12 can be utilized to form a trench for any of a number of different applications. For example, the trench-forming assembly 12 can be used to form trenches for drainage systems in building floors facilities to collect, remove, and/or recycle excess water or other liquids. These trenches can also be used as utility chases to provide temporary or permanent routing of electrical lines, pipes, conduits or the like below the level of the building floor. In addition, the trench-forming assembly 12 can be used to form trenches at any of a number of outdoor industrial and commercial sites, such as parking lots, to collect and direct rainwater and other liquids to underground storm sewers to prevent flooding and to decrease run-off. Also, for example, the trench-forming assembly 12 can be used to form trenches for drainage of roadways and the like.

The trench-forming assembly 12 includes an elongate form body 14 (also referred to herein as a "form" or "form body") and a pair of longitudinal frame members 16. The elongate form body 14 includes a top surface, a bottom surface, and opposed side surfaces for forming a moldable trench forming composition, such as a cementitious composition, into a trench of predetermined shape. While the form body 14 can have a variety of configurations, as is well known in the art, including having slots to assist in removal of the form body. Some of the many configurations of the form body 14 are illustrated in U.S. Pat. Nos. 5,281,051, 5,348,421, and 6,926,245, all of which are assigned to the assignee of the present invention and incorporated herein by reference.

In the illustrated embodiment, the frame members 16 define a surface for supporting a trench cover, such as a metal grate, and typically serve directly as a support surface for the trench cover. Alternatively, the frame members can function as shaping elements for shaping the hardenable trench forming composition into a pair of recesses for receiving a trench cover, in which case the frame members are removed to expose the trench cover receiving recesses following hardening of the trench forming composition. Further discussion of such removable frames members is provided in considerable detail in the incorporated '051 patent.

Whereas the frame members 16 can be made from any of a number of different materials, in one embodiment the frame members are made from aluminum. The frame members 16 can have a variety of different configurations, as is well known in the art, provided that the frame members include at least an upper portion that is relatively vertical and planar when the frame members are secured to the form body 14. Such a configuration of the frame members 16 is described in considerable detail in the incorporated '051 and 421' patents. Additionally, the frame members 16 preferably have the same profile along their entire length and, as such, the frame members can be fabricated by extruding molten aluminum through a die or the like. Thus, the frame members 16 need not be fabricated according to multiple steps of fabricating the individual components and thereafter affixing the components to one another, as required by conventional techniques.

The form body 14 typically includes means formed along the opposed side surfaces for attaching the frame members 16 with the form. For example, one or more slots can be formed on each opposed side surface of the form body 14 to receive at least a portion of each frame member 16. The configuration and location of the slots will depend on the configuration of the frame members 16. Such slots are also discussed in detail in the incorporated '051, 421', and 245' patents. Various details disclosed in the incorporated '051, 421', and 245' patents are not repeated herein for the sake of brevity. However, reference may be had to the incorporated '051, 421', and 245' patents for such details. The one or more slots defined in the opposed side surfaces of the form body 14 are structured to receive and maintain the frame members 16 in a predetermined coplanar, spaced relationship above the bottom surface of the form body.

Affixed to the frame members 16, the trench-forming assembly 12 can also include a plurality of anchoring legs 18 extending downwardly from the frame members (shown in FIG. 1). The anchoring legs 18 can be affixed to the frame members in any one of a number of different manners, such as by securing the anchoring legs to the frame members by means of screws, rivets or the like. As subsequently discussed, the anchoring legs are adapted to anchor the form body in a subslab (as described in the incorporated '245 patent) of moldable trench forming composition poured around the lower portion of each of the legs and below the bottom surface of the form body 14. These anchoring legs 18 further facilitate the retention of the frame members 16 within the trench formed of hardenable trench forming composition. The anchoring legs 18 can be positioned at ends of the frame members 16 so as to overhang respective ends. In this regard, the anchoring legs 18 can also be used to interconnect multiple sections of frame members 16 of the trench-forming assembly. However, each trench-forming assembly 12 may include a different number of anchoring legs 18 and/or anchoring legs at different positions along the frame members 16. The anchoring legs 18 are also discussed in detail in the incorporated 245' patent. Various details disclosed in the incorporated 245' patent are not repeated herein for the sake of brevity. However, reference may be had to the incorporated 245' patent for such details.

The frame members 16 can also include a plurality of additional anchors 20, otherwise known as Nelson studs, extending outwardly and downwardly from both of the frame members 16 at longitudinally spaced locations therealong. These anchors are adapted to extend into and be engaged by the hardenable trench forming composition poured about the removable form. These additional anchors further facilitate the retention of the frame members 16 within the trench formed of hardenable trench forming composition.

It should be noted that the shape of the form body 14 and, particularly the top surface of the form body, can vary depending upon the configuration of the frame members 16, or vice versa.

As indicated in the background section, the anchoring legs 18 of the trench-forming assembly 12 generally maintain the frame members 16 in position with respect to one another. However, the frame members 16 are typically still capable of moving somewhat with respect to one another. To limit such movement, conventional trench forming assemblies include one or more tie wires wrapped about the opposed frame members so as to bring the frame members into snug contact with the opposite sides of the form body 14. Once the cementitious material has begun to cure and the frame members are correspondingly affixed in position, the tie wires can be removed prior to removing the form to expose the resulting trench.

Referring to FIGS. 1-11, in contrast to utilizing tie wires in a conventional trench-forming assembly, the present invention utilizes of one or more alignment devices 10 to thereby improve the manner in which the alignment of the frame members 16 is maintained. While FIGS. 3-9 illustrate that the alignment devices of the present invention can comprise a variety of different configurations, each alignment device generally includes a cross member 22 and at least one pair of first lateral extensions 24.

Figure 3:
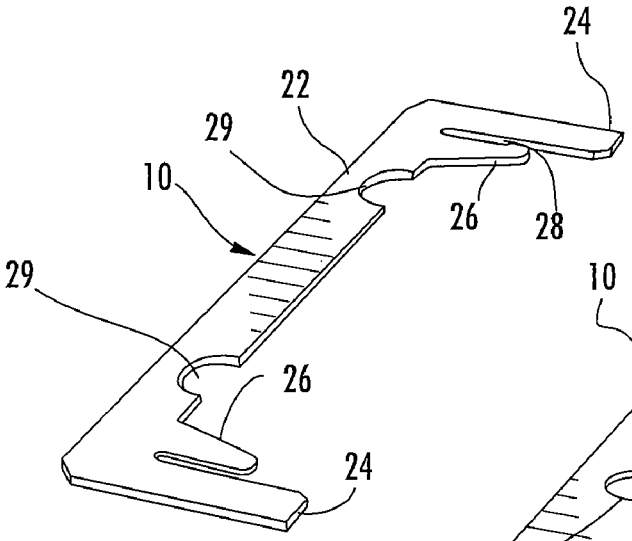
FIG. 3 illustrates a configuration of the alignment device, according to one embodiment of the present invention.

As illustrated in FIG. 3, each lateral extension 24 extends from one end of the cross member 22. In this regard, for each corresponding pair of lateral extensions 24, a first one of the pair of lateral extensions extends from the first end 22*a* of the cross member 22 in a first direction and a second one of the pair of lateral extensions extends from the second end 22*b* of the cross member in the first direction (i.e., the same direction as the first one of the pair of lateral extensions). These first lateral extensions are used to retain the alignment device 10 relative to the frame members 16 of the trench-forming assembly. In the illustrated embodiments, the pair of lateral extensions is spaced apart such that they fit or are in contact with the outside surfaces of the respective frame members. In this embodiment, the lateral extensions provide support or stabilization to restrict movement of the frame members away from one another. In other embodiments not shown, the pair of lateral extensions is spaced apart such that they fit or are in contact with the inside surfaces of the respective frame members. In this embodiment, the lateral extensions provide support or stabilization to restrict movement of the frame members toward one another. In some embodiments, one lateral extension may contact an outer surface of one frame member, while the other lateral extension contacts the inner surface of the other frame member.

In some embodiments, the alignment devices may further include one or more interior lateral extensions 26, corresponding to at least one of the pair of first lateral extensions. In this embodiment, the cross member 22 has respective first and second ends and a length extending between the first and second ends that is generally greater than the distance between the longitudinal frame members 16 when the frame members are attached to the form body 14. As illustrated in FIGS. 1, 2, 10, and 11, the alignment device includes a pair of interior lateral extension, each corresponding to a respective first lateral extension. Each of the first and second lateral extensions 24 of each pair and the corresponding interior extension(s) 26 define a slot 28 structured to receive at least a portion of one of the longitudinal frame members 16 when the cross member 22 extends between the longitudinal frame members to thereby maintain the alignment of the longitudinal frame members when the trench is being formed. As illustrated, these interior lateral extensions have at least two purposes. First, they aid in maintaining the alignment device 10 in engagement with the frame members 16. Second they also provide support or stabilization to restrict movement of the frame members toward each other. In other words, an alignment device 10 according to the present invention that includes both first lateral extensions 24 and corresponding interior lateral extensions 26 provide stability for the frame members 16 such that the frame members 16 are maintained at a relatively fixed distance relative to each other.

Figure 4:
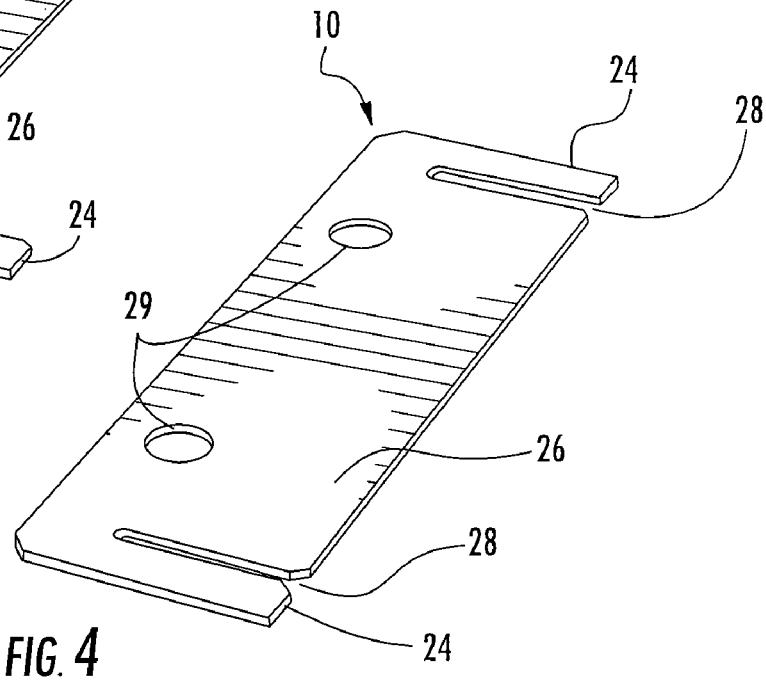
FIG. 4 illustrates a configuration of the alignment device, according to another embodiment of the present invention.
Figure 5:
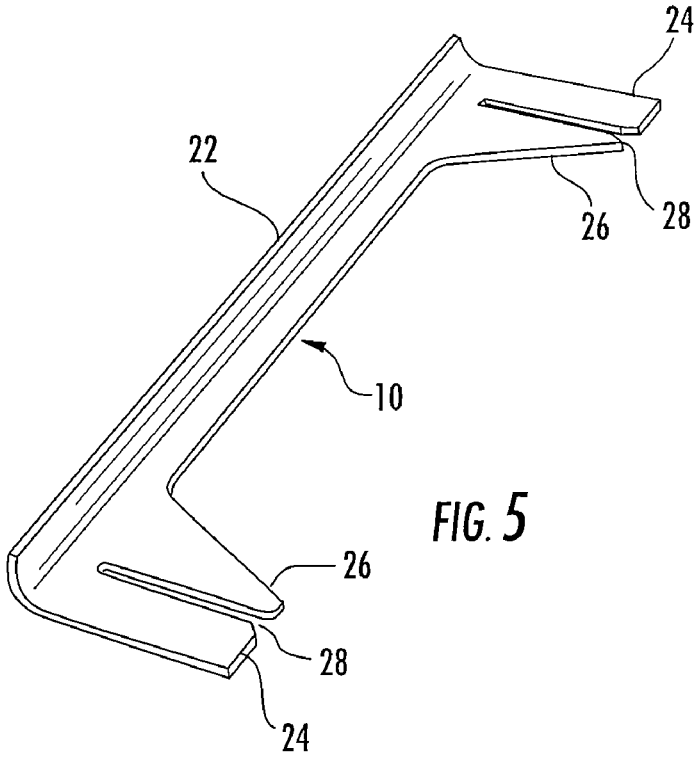
FIG. 5 illustrates a configuration of the alignment device, according to another embodiment of the present invention.
Figure 6:
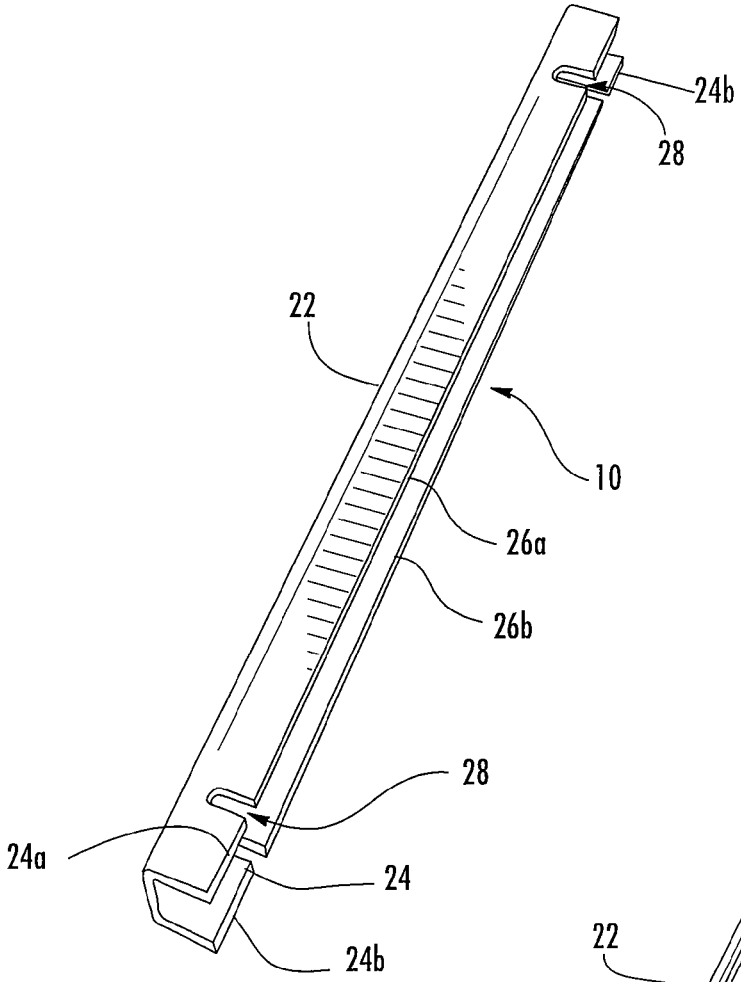
FIG. 6 illustrates a configuration of the alignment device, according to another embodiment of the present invention.

As illustrated in FIGS. 3-9, the configurations of the interior lateral extensions 26 will vary, depending of shape and dimensions of the form body 14 and frame members 16. In addition, in one embodiment, a slot or slots can be formed in the form body 14 to receive the interior extension(s). In other embodiments, as illustrated in FIGS. 5 and 6, the interior extensions(s) 26 of the alignment device can be constructed to have a point and/or edge for penetrating the form body 14, such as when expanded polystyrene is used to form the form body.

As illustrated in FIGS. 3-9, in addition to variations in the configuration and number of interior extension(s) 26 included relative to the first lateral extensions 24, the number of pairs and laterals extensions and corresponding interior extension(s) can also vary per alignment device 10. For example, according to some embodiments of the alignment device illustrated in FIG. 4, the device comprises one pair of lateral extensions 24 such that the cross member 22, pair of lateral extensions and interior extension(s) 26 define a planar cross section.

According to one embodiment, as illustrated in FIG. 4, the alignment device 10 comprises one interior extension that is sized so that it creates slots 28 with each of the first lateral extensions.

According to another embodiment of the alignment device illustrated in FIG. 5, the device comprises one pair of first lateral extensions 24 and a pair of interior lateral extensions. In this embodiment, the cross member 22 is L-shaped so as to create a lip or ledge for aiding in positioning and removal of the alignment device from the form assembly.

Figure 7:
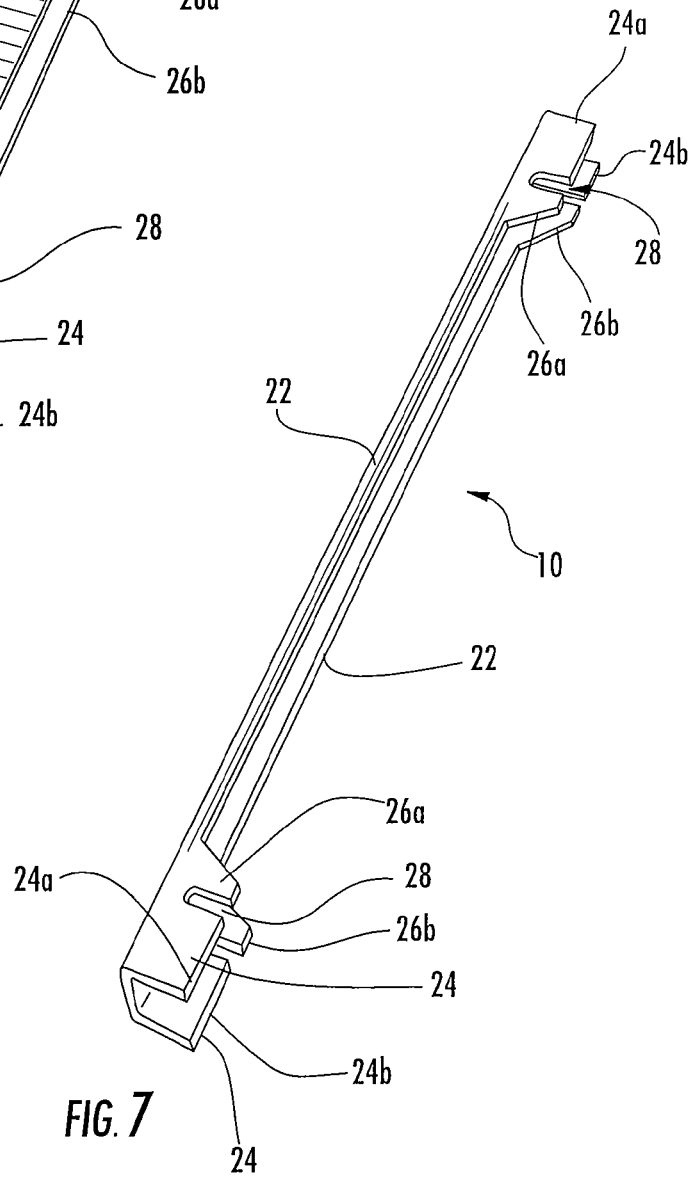
FIG. 7 illustrates a configuration of the alignment device, according to another embodiment of the present invention.
Figure 8A:
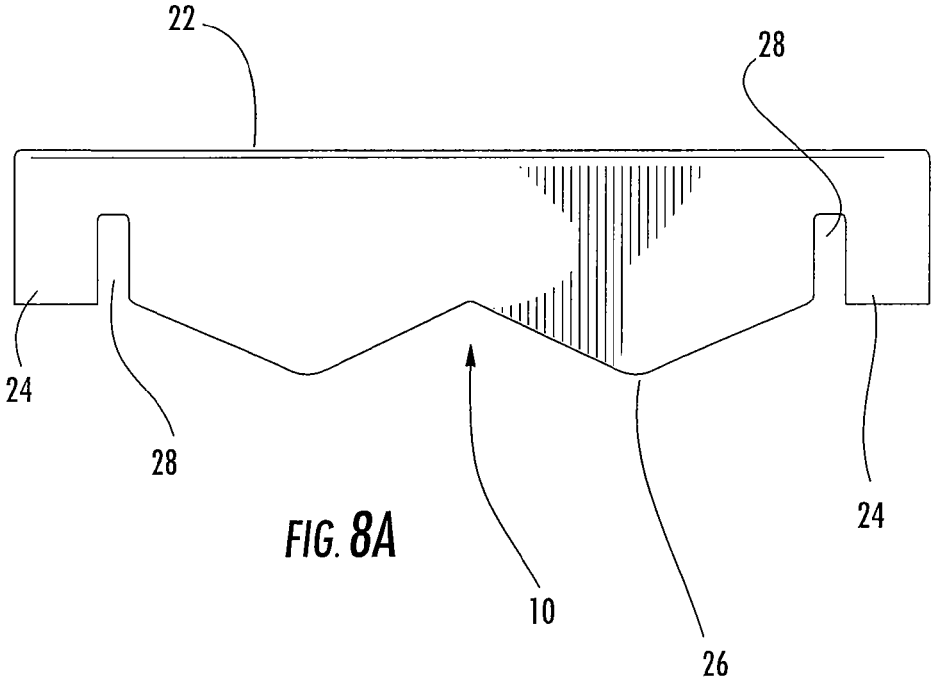
FIGS. 8A and 8B illustrate respective side and end views of a configuration of the alignment device, according to another embodiment of the present invention.
Figure 8B:
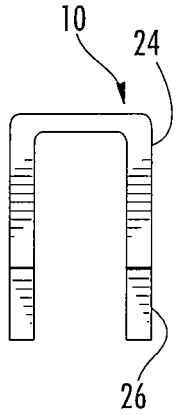

According to other embodiments of the alignment device 10 illustrated in FIGS. 6-8, the device comprises two or more pair of lateral extensions 24, in which the first lateral extensions 24*a* of each pair is spaced apart by a predetermined distance and the second lateral extensions 24*b* of each pair is spaced apart by a predetermined distance. For the illustrated examples according to this embodiment, the cross member 22, pairs of lateral extensions 24 and interior extension(s) corresponding to each pair of lateral extensions defines a C-shaped cross-sectional configuration. Note that in some embodiments, the interior lateral extensions 26 may comprises a pair of spaced apart extensions 26*a* and 26*b*.

Figure 9:
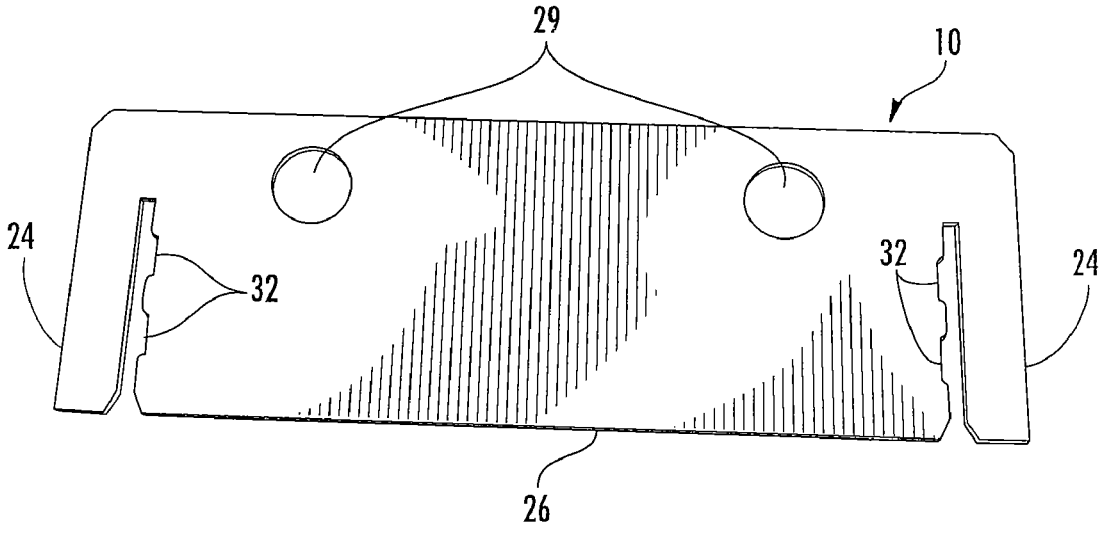
FIG. 9 illustrates a configuration of the alignment device, according to another embodiment of the present invention
Figure 10:
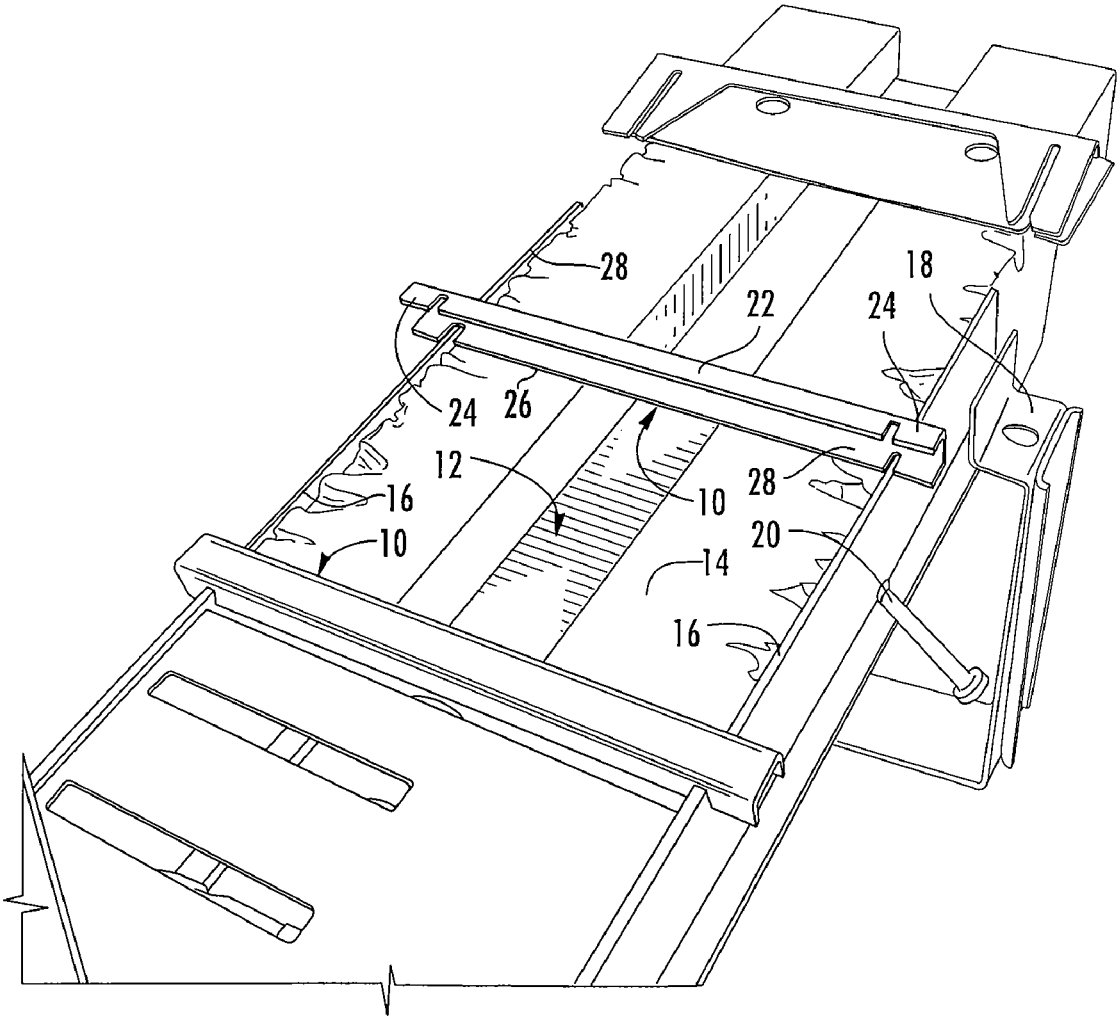
FIG. 10 illustrates alignment devices being engaged to a trench-forming assembly, according to another embodiment of the present invention.
Figure 11:
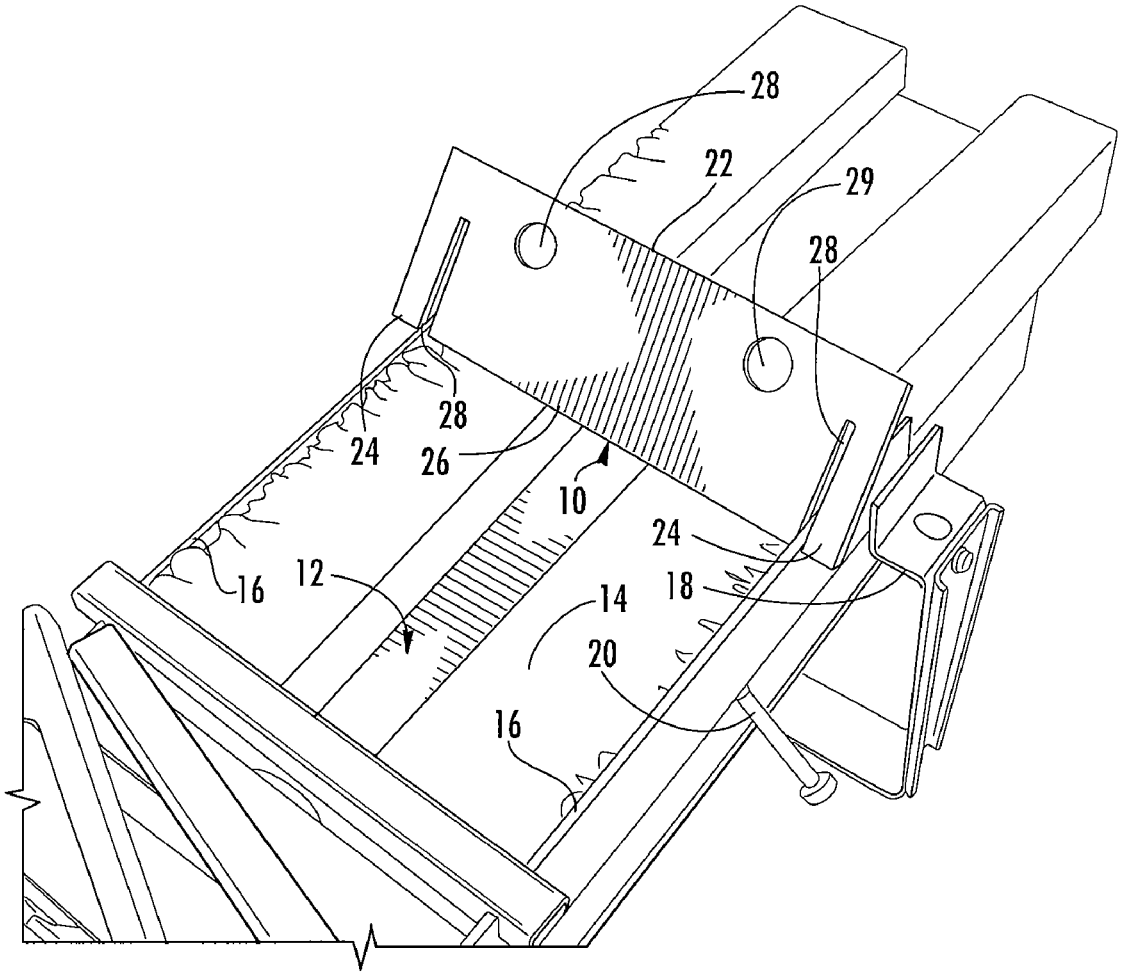
FIG. 11 illustrates alignment devices being engaged to a trench-forming assembly, according to another embodiment of the present invention.

Further, as shown in FIG. 9, the interior lateral extensions 26 may have one or more apertures 32 in their surfaces. These detents reduce the amount of surface of the interior lateral extensions in contact with the frame members so as to reduce friction and facilitate easy insertion and removal of the alignment device. While not illustrated, the first lateral extensions 24 may also incorporate such apertures.

In operation, a plurality of alignment devices 10 are positioned at longitudinally spaced locations along the length of the trench-forming assembly to maintain the alignment of the frame members 16. Preferably the alignment devices 10 are removable and reusable. For example, as illustrated in FIGS. 3 and 4, at least a portion of the cross member 22 can define at least one aperture 29 so that the alignment device 10 may be easily removed from the trench-forming assembly after the trench is formed.

The present invention also provides a method of forming a trench of predetermined shape The method comprises providing a trench-forming assembly comprising a form and a pair of longitudinal frame members secured to the form, the pair of longitudinal frame members being positioned in a parallel orientation about the form such that the longitudinal frame members are spaced apart a predetermined distance. The providing step can include forming slots in the form of the trench-forming assembly, each of the slots structured to receive at least one of the interior extension(s) of an alignment device. At least one alignment device is provided having at least one slot for at least partially receiving each one of the longitudinal frame members. The trench-forming assembly is positioned with a prepared ditch. The at least one alignment device is engaged with the trench-forming assembly whereby the at least one alignment device extends across the distance between the longitudinal frame members and each longitudinal frame member is at least partially received within at least one corresponding slot of the alignment device. The engaging step can be repeated so that the alignment devices are positioned at longitudinally spaced locations along the length of the trench-forming assembly. A moldable trench forming composition is poured around at least portions of the trench-forming assembly to form the trench of predetermined shape and wherein the at least one alignment device maintains the alignment of the longitudinal frame members during said pouring step.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An alignment device for use in maintaining the alignment of longitudinal frame members of a trench-forming assembly during formation of a trench, the longitudinal frame members being positioned in a generally parallel orientation about a form such that the longitudinal frame members are spaced at a distance apart from each other, the alignment device comprising:

a cross member having a length greater than the distance between the longitudinal frame members, said cross member having first and second ends;

at least one pair of first lateral extensions, a first one of each pair of said first lateral extensions extending from said first end of said cross member in a first direction and a second one of each pair of said first lateral extensions extending from said second end of said cross member in the first direction;

at least one interior extension corresponding to at least one of said pair of first lateral extensions, said at least one interior extension extending from said cross member in the first direction and between said corresponding at least one pair of first lateral extensions; and wherein one of said first and second ones of said at least one pair of first lateral extensions and said at least one interior extension defines a slot structured to receive at least a portion of one of the longitudinal frame members when said cross member extends between the longitudinal frame members to thereby maintain the alignment of the longitudinal frame members when forming the trench.

2. An alignment device according to claim 1, wherein at least a portion of said cross member defines at least one aperture so that the alignment device may be removed from the trench-forming assembly after the trench is formed.

3. An alignment device according to claim 1 further comprising at least one pair of interior extensions corresponding to each of said at least one pair of first lateral extensions, wherein a first one of said at least one pair of interior extensions corresponds to a first one of said at least one pair of first lateral extensions and a second one of said at least one pair of interior extensions corresponds to a second one of said at least one pair of first lateral extensions.

4. An alignment device according to claim 1 wherein said cross member, said at least one pair of first lateral extensions and said at least one interior extension defines a planar cross section.

5. An alignment device according to claim 1 further comprising two pair of first lateral extensions, said first ones of each of said pair of lateral extensions being spaced apart by a predetermined distance and said second ones of each of said pair of lateral extensions being spaced apart by a predetermined distance.

6. An alignment device according to claim 5 wherein said cross member, said pairs of lateral extensions and said at least one interior extension corresponding to each of said pair of lateral extensions defines a C-shaped cross-sectional configuration.

7. An alignment device according to claim 1, wherein at least one of said lateral extensions or said at least one interior extensions comprises an aperture in a surface of said lateral extensions or said at least one interior extension.

8. An alignment device for use in maintaining the alignment of longitudinal frame members of a trench-forming assembly during formation of a trench, the longitudinal frame members being positioned in a generally parallel orientation about a form such that the longitudinal frame members are spaced at a distance apart from each other, the alignment device comprising:

a cross member having a length extending between first and second ends; and at least one pair of first lateral extension spaced apart from one another and extending in the same direction from said cross member, wherein the distance between said pair of first lateral extensions is selected such that said pair of first lateral extensions are in contact with either an inside surface or an outside surface of the longitudinal frame members of the trench-forming assembly.

9. An alignment device according to claim 8, wherein said pair of first lateral extensions are spaced so to contact the outside surfaces of the longitudinal frames, wherein said device further comprises at least one interior extension corresponding to at least one of said pair of first lateral extensions, said at least one interior extension extending from said cross member in the first direction and between said corresponding at least one pair of first lateral extensions, and wherein one of said first and second ones of said at least one pair of first lateral extensions and said at least one interior extension defines a slot structured to receive at least a portion of one of the longitudinal frame members when said cross member extends between the longitudinal frame members to thereby maintain the alignment of the longitudinal frame members when forming the trench.

10. An alignment device according to claim 8, wherein said pair of first lateral extensions are spaced so to contact the outside surfaces of the longitudinal frames, wherein said device further comprises at least one pair of interior extensions corresponding to each of said at least one pair of first lateral extensions, wherein a first one of said at least one pair of interior extensions corresponds to a first one of said at least one pair of first lateral extensions and a second one of said at least one pair of interior extensions corresponds to a second one of said at least one pair of first lateral extensions.

11. A trench-forming assembly comprising:

a form;

a pair of longitudinal frame members secured to said form, said pair of longitudinal frame members being positioned in a generally parallel orientation about said form such that said longitudinal frame members are spaced at a distance apart from each other; and a plurality of alignment devices, each of said alignment devices comprising:

a cross member having a length greater than the distance between the longitudinal frame members, said cross member having first and second ends;

at least one pair of first lateral extensions, a first one of each pair of said first lateral extensions extending from said first end of said cross member in a first direction and a second one of each pair of said first lateral extensions extending from said second end of said cross member in the first direction;

at least one interior extension corresponding to at least one of said pair of first lateral extensions, said at least one interior extensions extending from said cross member in the first direction and between said corresponding at least one pair of lateral extensions; and wherein one of said first and second ones of said at least one pair of lateral extensions and said at least one interior extension defines a slot structured to receive at least a portion of one of the longitudinal frame members when said cross member extends between the longitudinal frame members to thereby maintain the alignment of the longitudinal frame members when forming the trench.

12. An alignment device according to claim 11, wherein at least a portion of said cross member defines at least one aperture so that the alignment device may be removed from the trench-forming assembly after the trench is formed.

13. An alignment device according to claim 11 further comprising at least one pair of interior extensions corresponding to each of said at least one pair of lateral extensions, wherein a first one of said at least one pair of interior extensions corresponds to a first one of said at least one pair of lateral extensions and a second one of said at least one pair of interior extensions corresponds to a second one of said at least one pair of lateral extensions.

14. An alignment device according to claim 11 wherein said cross member, said at least one pair of lateral extensions and said at least one interior extension defines a planar cross section.

15. An alignment device according to claim 11 further comprising two pair of first lateral extensions, said first ones of each of said pair of first lateral extensions being spaced apart by a predetermined distance and said second ones of each of said pair of first lateral extensions being spaced apart by a predetermined distance.

16. An alignment device according to claim 15 wherein said cross member, said pairs of first lateral extensions and said at least one interior extension corresponding to each of said pair of first lateral extensions defines a C-shaped cross-sectional configuration.

17. A trench-forming assembly comprising:

a form;

a pair of longitudinal frame members secured to said form, said pair of longitudinal frame members being positioned in a parallel orientation about said form such that said longitudinal frame members are spaced apart a predetermined distance; and a plurality of alignment devices, each of said alignment devices comprising:

a cross member having a length extending between first and second ends; and at least one pair of first lateral extension spaced apart from one another and extending in the same direction from said cross member, wherein the distance between said pair of first lateral extensions is selected such that said pair of first lateral extensions are in contact with either an inside surface or an outside surface of the longitudinal frame members of the trench-forming assembly.

18. A method of forming a trench of predetermined shape, the method comprising:

providing a trench-forming assembly comprising a form and a pair of longitudinal frame members secured to the form, the pair of longitudinal frame members being positioned in a parallel orientation about the form such that the longitudinal frame members are spaced apart a predetermined distance;

providing at least one alignment device having at least one slot for at least partially receiving each one of the longitudinal frame members;

positioning the trench-forming assembly into a prepared ditch;

engaging the at least one alignment device with the trench-forming assembly whereby the at least one alignment device extends across the distance between the longitudinal frame members and each longitudinal frame member is at least partially received within at least one corresponding slot of the alignment device; and pouring a moldable trench forming composition around at least portions of the trench-forming assembly to form the trench of predetermined shape and wherein the at least one alignment device maintains the alignment of the longitudinal frame members during said pouring step.

19. A method according to claim 18 further comprising repeating said engaging step prior to said pouring step.

20. A method according to claims 18 wherein said second providing step comprises providing at least one alignment device comprising;

a cross member having a length greater than the distance between the longitudinal frame members, the cross member having first and second ends;

at least one pair of first lateral extensions, a first one of each pair of the first lateral extensions extending from the first end of the cross member in a first direction and a second one of each pair of the first lateral extensions extending from the second end of the cross member in the first direction;

at least one interior extension corresponding to at least one of said pair of first lateral extensions, the at least one interior extensions extending from the cross member in the first direction and between the corresponding at least one pair of first lateral extensions; and wherein one of the first and second ones of the at least one pair of first lateral extensions and the at least one interior extension defines a slot structured to receive at least a portion of one of the longitudinal frame members when the cross member extends between the longitudinal frame members.

21. A method according to claim 20 wherein the first providing step comprises forming slots in the form of the trench-forming assembly, where the slot is structured to receive the at least one interior extension.

22. A method according to claims 18 wherein said second providing step comprises providing at least one alignment device comprising;

a cross member having a length extending between first and second ends; and at least one pair of first lateral extension spaced apart from one another and extending in the same direction from said cross member, wherein the distance between said pair of first lateral extensions is selected such that said pair of first lateral extensions are in contact with either an inside surface or an outside surface of the longitudinal frame members of the trench-forming assembly.

* * * * *